United States Patent [19]

Giraud et al.

[11] Patent Number: 4,806,924

[45] Date of Patent: Feb. 21, 1989

[54] METHOD AND SYSTEM FOR DISPLAYING INFORMATION

[76] Inventors: Daniel Giraud, 6 rue Coste, 78000 Versailles; Régis Dufrenne, 9 rue Antoine St. Exupéry; Jean Charron, 2 rue Louise-Michel, both of 78360 Montesson, all of France

[21] Appl. No.: 747,278

[22] Filed: Jun. 21, 1985

[30] Foreign Application Priority Data

Jun. 29, 1984 [FR] France ..... 84 10404

[51] Int. Cl.[4] ..... G09G 3/22

[52] U.S. Cl. ..... 340/792; 455/609; 340/705; 340/706; 340/708

[58] Field of Search ..... 340/705, 716, 717, 724, 340/791, 792, 755, 706, 709, 707, 708; 250/495.1, 491.1; 455/609, 603

[56] References Cited

U.S. PATENT DOCUMENTS

| | | | |
|---|---|---|---|
| 3,704,064 | 11/1972 | Sollogoub et al. | 352/100 |
| 3,710,180 | 1/1973 | Rooks | 340/792 |
| 4,174,524 | 11/1979 | Moran | 455/609 X |
| 4,209,689 | 6/1980 | Linford et al. | 455/609 |
| 4,347,507 | 8/1982 | Spooner | 340/705 |
| 4,359,730 | 11/1982 | Kunikane et al. | 340/792 |
| 4,365,245 | 12/1982 | Colmenero | 340/791 X |
| 4,390,861 | 6/1983 | Cohen et al. | 340/705 X |
| 4,462,026 | 7/1984 | Munday | 340/791 X |
| 4,565,999 | 1/1986 | King et al. | 340/707 |
| 4,595,836 | 6/1986 | Simpson | 250/491.1 |

FOREIGN PATENT DOCUMENTS 2461140 12/1975 Fed. Rep. of Germany .

*Primary Examiner*—Marshall M. Curtis
*Attorney, Agent, or Firm*—Steinberg & Raskin

[57] ABSTRACT

The present invention relates to an advertising information display system comprising a device for starting the display of the advertising information on certain elements of the display panels; a computer device receiving information from the output of the various infrared radiation pick-ups emitting logic signals towards the display monitoring and control device associated with each panel to cause the displacement of the message on the display panel elements in accordance with the movements of the camera.

21 Claims, 2 Drawing Sheets

FIG. 1
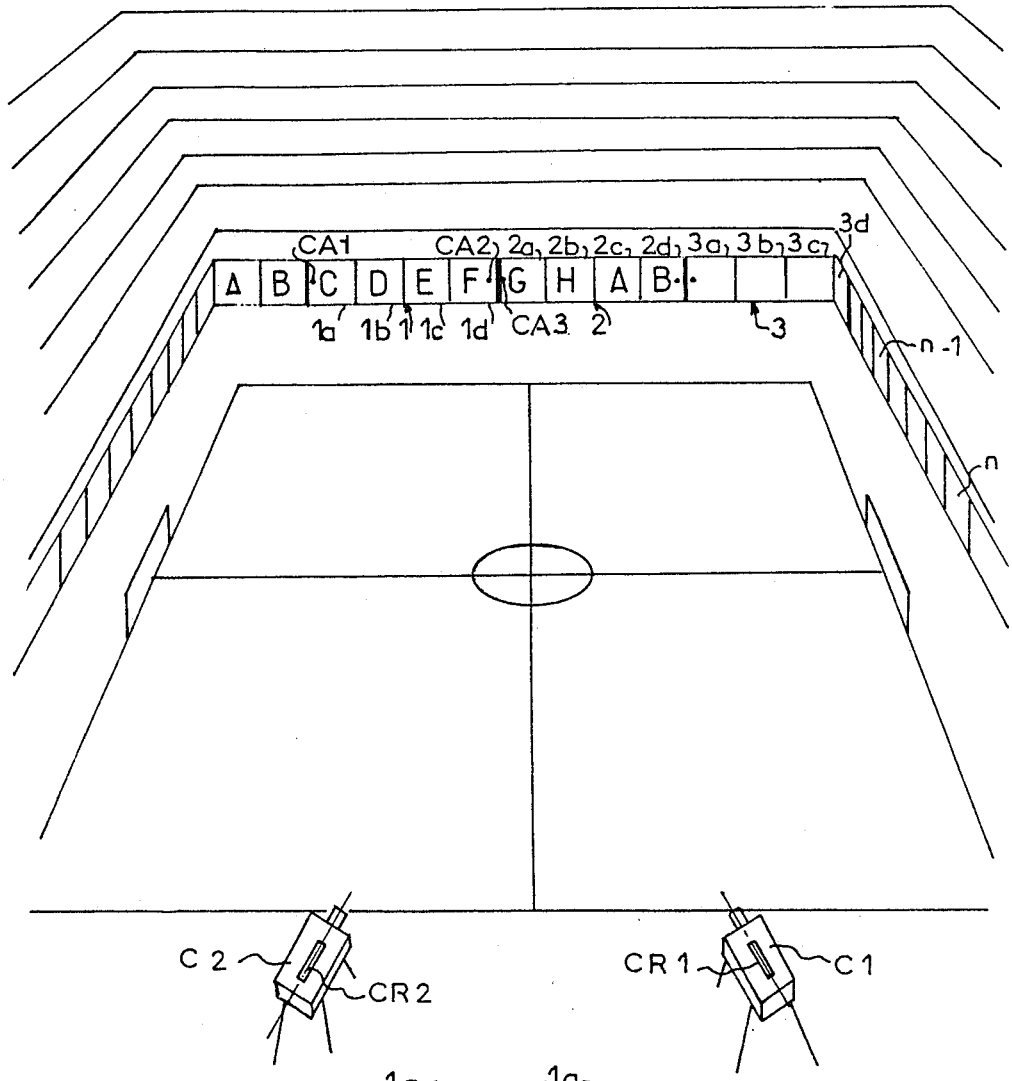
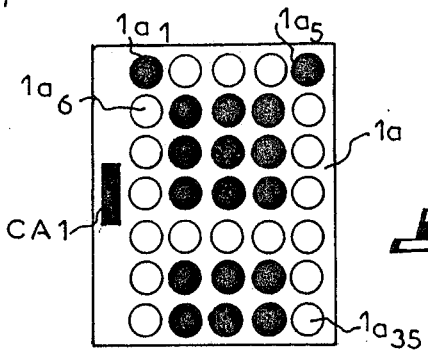
FIG. 2

METHOD AND SYSTEM FOR DISPLAYING INFORMATION

BACKGROUND OF THE INVENTION

The present invention has for a subject matter a method of displaying information, such as for example advertising messages, on a certain number of panels with display elements arranged at a place of sporting events such as football, basket-ball or other contests intended to be televised, and the display system for carrying out the said method.

There are known systems for displaying advertising messages on a certain number of panels with display elements arranged, in particular, around a football field or a basket-ball court, including means of automatic control of the message display with an effect of continuous running of the latter on the panels considered.

Due to the fact, however, that the rnning display is always addressed to the same panels, such systems suffer from the disadvantages that, in the long run, they no longer draw the public's attention and that, in case of televised transmission, the display of the advertising message very seldom appears entirely on a final television receiving means such as a television set.

SUMMARY OF THE INVENTION

The present inveniton has for a purpose to eliminate the above disadvantages of the prior-art systems.

To this end, the invention provides a method of displaying information, such as for example advertising messages, capable of moving on a certain number of panels with display elements arranged at a place of sporting events such as football, basket-ball or other contests intended to be televised to at least one final television receiving means from television cameras, at least one of said display panels appearing at said final television receiving means, said method being characterized in that it consists in starting the display of an advertising message every time at least one of the panels is located in the shooting field of one of the cameras in operation; and in controlling the displacement of the message on the panels in accordance with the movements of the camera so as to cause the message to continually appear at the final television receiving means.

According to one feature of the invention, the method consists in determining the length or the size of the advertising message according to the operating focal distance of the camera so that the message always is entirely within the shooting field of the camera.

According to another feature of the invention, the method consists in starting the display from the emission of an infrared radiation from the camera at the time of its putting into operation and received by at least one infrared radiation pick-up placed on one of the display panels.

According to still another feature of the invention, the method consists in determining the starting position of the message display on the display panel elements and in determining also the message portion concerned for each panel according to the camera operating focal distance.

According to still another feature of the invention, the message displacement, the display starting position, the message portion concerned for each panel, the type of message to be displayed and the message displacement speed take place under the control of a computer device.

According to still another feature of the invention the method consists in pulsing the infrared radiation and in inserting into the active portion of the pulsed infrared signal coded information signals indicating the nature of the camera used and, if appropriate, the relative position of the camera with respect to the display panels.

According to still another feature of the invention, the method consists in providing, according to a predetermined program of the computer device, for the location of a message on the various display panel elements according to the excitation time of each infrared radiation pick-up when the camera in motion is operating at a focal distance corresponding to a medium shooting-field.

The invention also provides a display system for carrying out the method of the invention, including a certain number of panels with display elements arranged at a place of sporting events such as football, basket-ball or other contests, a certain number of television cameras for televising to at least one final television receiving means, such as a television set, said sporting event, at least one of the display panels appearing at the said final television receiving means, said system being characterized in that it includes, in association with each of the cameras, an element arranged on each of the cameras and sensitive to an "On-the air" visual indicator of the camera, and a device, activated by the said sensitive element, for starting the display of an advertising message every time at least one of the display panels is within the shooting field of one of the cameras put into operation; a computer device receiving the output information from the various starting devices and emitting logic signals towards a display monitoring and control device associated with each panel to control the displacement of the message on the display panel elements in accordance with the movements of the camera to thus cause the said message to continually appear at the final television receiving means.

According to one feature of the invention, the starting device includes an infrared radiation gun aligned with the camera shooting axis and a certain number of infrared radiation pick-ups arranged at regular intervals on the display panels and connected to the computer device, each signal emitted from the output of a pick-up receiving the infrared radiation containing information identifying the said pick-up and other information relating to the operating focal distance of the camera so that the message is always entirely within the shooting field of the camera.

According to another feature of the invention, the preferably ASCII-coded logic signals is emitted by the computer device, in addition to controlling the aforesaid displacement, indicate the displayed message, the display starting position for each panel, the message portion concerned for each panel and the message displacement speed on the display panel elements.

Still according to another feature of the invention, the system also includes an electronic device for pulsing the infrared radiation emitted by the emitting diode of each infrared radiation gun and means for inserting into the active portion of the pulsed signal the information relating to the nature of the camera in operation and, if appropriate, the position of the camera with respect to the display panels.

BRIEF DESCRIPTION OF THE DRAWINGS

For a fuller understanding of the invention, reference is made to the following description, taken in connection with the accompanying drawings, in which:

FIG. 1 is a perspective view of the arrangement of the panels to which the present invention applies about a place of sporting events such as for example a football field, FIG. 2 illustrates the type of display elements constituting each display panel to which the invention applies.

DESCRIPTION OF THE PREFERRED EMBODIMENTS

Figure 3:
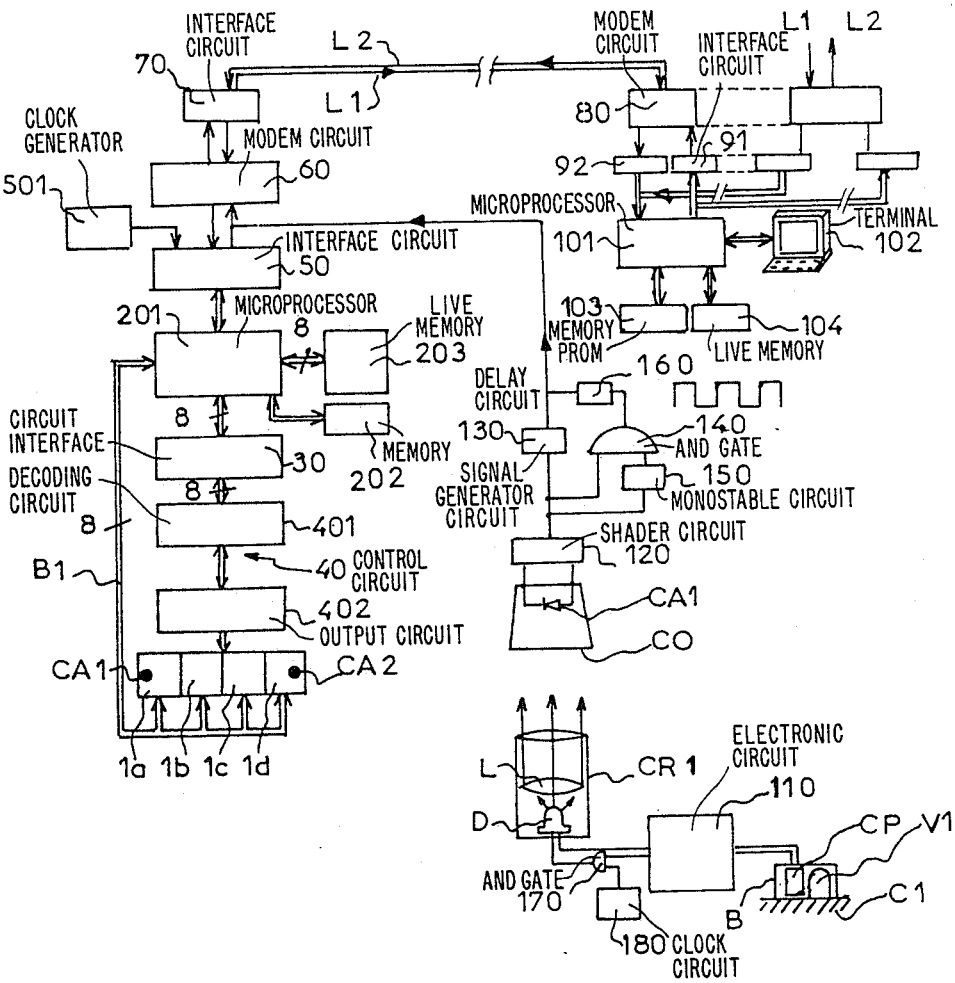
FIG. 3 is a functional block diagram of the display system of the invention.

FIG. 1 shows a certain number of display panels 1, 2, 3, . . . , n arranged about a football field. In the case considered, the display panels are arranged in series along a horizontal line, but it is of course understood that they may also be arranged in series in the form of vertical columns, thus allowing any form of display to be obtained.

Each display panel, e.g. panel 1, includes several display elements, four in number in the case considered, designated by 1*a*, 1*b*, 1*c*, 1*d* and arranged side by side. Each of these display elements, shown in detailed form in FIG. 2, contains 35 display spots $1a_1$–$1a_{35}$ arranged in a matrix of 5×7 pellets or the like allowing the display of any desired alphanumeric character. Such display elements are known and will only be described very briefly for a better understanding.

Each character is constituted by bistable pellets which alternately present a coloured face or a black face by the effect of a magnetic core whose field is controlled by a current impulse passing at a high speed through the coil of each pellet. Each display spot contains a magnetic memory and indefinitely retains the same condition when the current is switched off. Each row of spots has a display and blanking line which is connected to the positive end of each coil of the row through the medium of blocking diodes. The negative end of each coil in the vertical direction is connected to a common vertical return circuit. When an impulse is furnished to the horizontal display line and the vertical return circuit is closed, there is displayed the spot at the intersection. All the display elements are connected to a control device, which will be described later, through the medium of connectors (not shown) placed at the base of the display panels.

Of course, other types of display elements, such as for example 35-point display elements with light-emitting diodes may be suitable within the scope of the present invention, the main thing being that the display elements should be visible from a relatively long distance, e.g. 60 meters.

FIG. 1 also shows the presence of television cameras C1, C2 intended for televised transmission of the sporting event, the signals emitted by these cameras being processed in a manner known per se in a master control room ensuring pre-recorded or live broadcast of the sporting event towards several final television receiving means such as television receiver sets. The cameras used may be mobile cameras, stationary cameras capable of operating with a focal distance corresponding to a wide shooting field or to a medium shooting field. In the present case, for the sake of simplification, the cameras C1 and C2 are stationary cameras, the camera C1 operating in wide-field mode and the camera C2 opeating in average-field mode.

Each television camera used for a live or a pre-recorded emission is equipped with an infrared radiation gun designated by CR1 for the camera C1 and by CR2 for the camera C2. Each gun CR1, CR2 is aligned with the shooting axis of the associated camera. Each of these guns is shown in FIG. 1 diagrammatically, but it is understood that it is adequately secured on each camera, for example by means of fastening lugs.

The guns CR1 and CR2 emit an infrared radiation of the same frequency corresponding for example to a wave-length of 100 nanometers and are supplied from independent storage batteries.

As is known per se, each camera is also provided with an "on-the-air" visual indicator V1, V2, each of such indicator lights being switched on when the camera is switched into transmission and being switched off when the camera is switched out of transmission.

Each display panel 1,2,3, . . . , n, includes pick-ups for the infrared radiation emitted by each gun CR1, CR2. FIG. 1 illustrates the use of two infrared radiation pick-ups arranged in proximity to each of the longitudinal ends of each panel and designated by CA1, CA2 for the display panel 1. The number of pick-ups is given by way of example and depends, of course, on the size of each display panel.

Referring now to FIG. 3, there will be described the complete display system of the present invention.

This system includes a monitoring and control device 20 for the display of characters at the display panel 1, there being provided as many monitoring and control devices as there are display panels. The monitoring and control device 20 includes a microprocessor 201, e.g. Motorola's MC 6809, the operation of which is monitored by a program stored in an erasable PROM memory 202 with a capacity of for example 3072 words of 8 bits. A live memory 203, e.g. of the RAM type, is bidirectionally connected to the microprocessor 201 and has a capacity of for example 256 words of 8 bits. In the RAM memory 203 are stored the codes of each character which may be displayed at one of the display elements 1*a*–1*d* of the panel 1.

The microprocessor 201 is bidirectionally connected by an 8-bit bus to an interface circuit 30 such as a Motorola PIA, the outputs of the said interface circuit being connected to a bipolar control circuit 40 including data decoding circuits 401 connected to output circuits 402 controlling the display elements according to the X-Y or column- row technique.

The microprocessor 201 directly addresses the display elements 1*a*-1*d* through the medium of the address bus B1.

Furthermore, the microprocessor 201 is connected through a bidirectional link to an interface circuit 50 for synchronous communication such as Intel's USART 8251 A circuit. A clock generator 501 is connected to the interface circuit 50 to provide the information rate during asynchronous communications, such rate being adjustable within a range of from 110 to 9600 bauds.

The interface circuit 50 is connected to a modem circuit 60 known per se, itself connected to an RS 232C interface cicuit designated by the reference numeral 70 and defining a serial linking mode. This interface circuit may also be a 20 mA current loop, also known per se as a linking mode.

The output of the interface circuit 70 is connected through the medium of a two-conductor cable of the telephone type L1, L2 to a modem circuit 80. The circuit 80 is connected to a microprocessor 101 forming part of the computer device 100 through the medium of an interface circuit 92 for information input into the microprocessor and an interface circuit 91 for information output from the microprocessor. These interface circuits may also be Motorola PIA circuits. The microprocessor 101 is bidirectionally connected to a terminal unit 102 and to a PROM memory 103 is which a microprocessor operation monitoring program is stored. A live memory 104 of the RAM type is also bidirectionally connected to the microprocessor 101 and contains the coded information relating to any display decision as will be explained later. Of course, the unit 102 is intended to compose coded messages stored thereafter in RAM 104.

FIG. 3 shows the presence of the "on-the-air" visual indicator V1 of the camera C1, to which is applied an element sensitive to the light emitted by this indicator, which element may be for example a photocell CP isolated from the ambient light by a casing represented diagrammatically at B.

When excited by the "on-the-air" indicator V1, the photocell orders the emission of infrared radiation by the gun CR1 of the corresponding camera.

The photocell CP is connected to an electronic circuit 110 which, when put into operation as a result of the excitation of the photocell CP, ensures the pulsation of the infrared radiation emitted by the emitting diode D of the infrared radiation gun CR1. Various prior-art types of electronic circuits capable of pulsing an infrared radiation are available, so that the circuit does not need to be described here in more detail. It should be noted that the infrared radiation emitting diode D may be the LD271 diode manufactured by Siemens, which ensures a considerable range of the radiation as well as an excellent directivity thereof. A lens L is suitably mounted in the gun CR1 to render the beam from the diode D parallel. With such an arrangement, a range of radiation of about 100 meters can easily be reached.

Each infrared radiation pick-up, the pick-up CA1 in the case considered, is constituted by a PIN diode mounted, if suitable, within a taper envelope CO for a better reception of the infrared radiation emitted by the gun CR1.

The pick-up CA1 is connected to a shaper circuit 120 for shaping the output signal of the pick-up. The output of the circuit 120 is connected to an address signal generator circuit 130, the output of which is connected to the input of the modem circuit 60.

The output of the shaper circuit 120 is also connected, on the one hand, to an input of an AND gate 140 and, on the other hand, to the input of a monostable circuit 150 whose output is connected to another input of the AND gate 140. The output of the AND gate 140 is connected through the medium of a delay circuit 160 to the output of the circuit 130.

Figure 4:
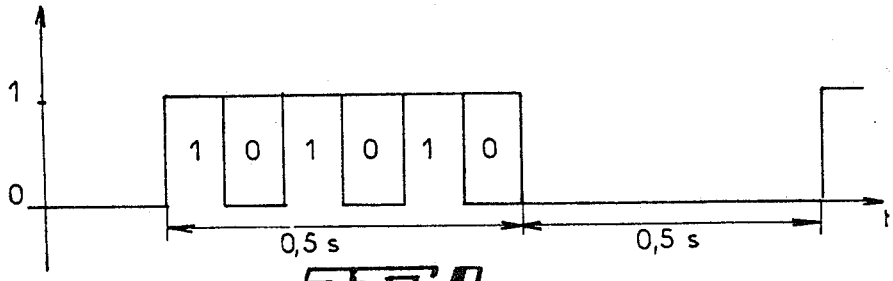
FIG. 4 illustrates by way of example the shape of the pulsed signals emitted by each radiation gun.

FIG. 3 also shows the presence of an AND gate 170 connected in series, through one of its inputs and its output, with the diode D, the other input terminal of the AND gate being connected to a clock circuit 180. The function of the circuit constituted by the gate 170 and the clock 180 consists in inserting into the active portion, i.e. at the higher level, of the pulsed signal emitted towards the diode D, signals for identifying the nature of the camera in operation. Thus, since the camera C1 has been defined as being a wide-field-mode operating camera, the signals inserted into the active part of the pulsed signal are representative of this type of cameras. FIG. 4 illustrates in detail the signals carried by the infrared radiation emitted. The infrared radiation emitted by the diode D is pulsed for, example, 0.5 second, followed by an interruption of the same duration. Into the high-level impulses of the pulsed signal are inserted several impulse signals identifying the nature of the camera. In the present case, three impulse signals are inserted, thus resulting in the binary code 101010.

It is furthermore to be noted that the serial input of the interface circuit 50 accepts ASCII-coded serial, asynchronous information representative of the input message proceeding from the computer device 100. This code, known per se, may, if suitable, be provided with parity check in order to detect errors possibly occurred during the transmission.

There will now be described the operation of the display system of the present invention.

When the camera C1 is switched into the program, the indicator light V1 is switched on, thus exciting the photocell CP which gives an order of emission of the infrared radiation from the diode D, this radiation carrying the camera identifying information.

During the movement of the camera corresponding for example to a pan-shot, the infrared radiation gun CR1 is directed for example towards the pick-up CA1 which thus receives the infrared radiation. The corresponding pulsed electrical signal appearing at the output of the pick-up CA1, after being shaped, is supplied, on the one hand, to the address code generator 130, thus causing the same to produce an address signal corresponding to the excited pick-up, and, on the other hand, to the monostable circuit 150 whose output is then at a high level during 0.5 second corresponding to the active duration of the higher level of the pulsed signal. There is thus obtained at the output of the AND gate 140 the camera identifying impulse signal previously inserted into the pulsed signal. This coded identifying signal is delayed so as to be transmitted in series to the modem circuit 60 after the address signals issued from the generator 130. This information is then transmitted through the line L1, L2, the modem circuit 80 and the interface circuit 92 to the microprocessor 102 of the computer device 100. The computer device is then informed of the excitation of the pick-up CA1 by the infrared radiation proceeding from the camera C1. After the processing of this information and under the control of the program in PROM 103, the computer device 100 emits towards the monitoring and control devices 20 a series of ASCII-coded signals including an address portion indicating the panel where the display is to take place (the panel 1 in the case considered), as well as the display element or elements concerned, and a data portion indicating the character to be displayed on the display element or elements concerned. These coded signals are then received by the microprocessor 201 which, under the control of the program in the memory 202, will appropriately address the memory 203, the contents of certain memory cells of which, corresponding to the character or characters to be displayed, will be decoded by the circuit 401 to operate the display element or elements concerned.

The above-described process of emission of these ASCII-coded information signals takes place also towards other display panels addressed according to the nature of the camera.

Thus, by reason of the wide-field-mode operation of the camera C1 and of the computer device 100 being informed about the nature of this camera, the series of coded signals emitted by the device 100 also address for example two adjacent panels at the left of panel 1 (in FIG. 3) and two other adjacent panels at the right of the panel 1, each monitoring and control device associated with each of the panels receiving and processing, of course, each series of coded signals. The monitoring and control devices also address the element or elements of the panels concerned to display the corresponding character or characters of the advertising message to be displayed. This message, at the moment the pick-up CA1 is excited, is therefore displayed on the five display panels arranged side by side, the length or the size of the message corresponding substantially to the shooting field of the camera C1 so that this message can integrally appear on a screen of a television receiver.

Due to the wide-field operation of camera C1, the pan displacements are small. It can therefore be assigned a type of message of great length and a certain number of panels, for example five in number as described previously, to display this message. It can therefore be considered that the display of great length of the message will take place when camera C1 will be switched into transmission despite the small displacements of the camera where the infrared radiation from the gun CR1 would excite either of the pick-ups located on either side of the pick-up CA1.

To sum up, when the shooting of a sporting contest takes place from a camera operating in large-field mode, the computer system 100 assigns, through the medium of the monitoring and control circuit 20, the type of message to be displayed on the panels after the excitation of one of the infrared radiation pick-ups in the shooting-field.

Of course, if another wide shooting-field camera is put into operation after the use of camera C1, the computer device 100 orders the blanking of the information displayed on the abovementioned five panels and assigns to other panels in the shooting field of the secod camera the type of message to be displayed which, of course, may be different from the first displayed message.

The operation of the display system will now be explained when use is made of the camera C2 having a medium of relatively small shooting field. In this case, the displacements of the camera are important. To explain the basic principle of operation of the system of the invention during the shooting from a medium-field camera, it will be assumed that the message to be displayed can be contained entirely on eight consecutive display panels elements and that the displayed message is the message ABCDEFGH.

When the camera C2 is switched into program, the light indicator V2 is switched on the excite the corresponding photocell CP which then activates the electronic circuit 110 allowing the pulsing of the infrared radiation emitted by the diode D of the gun CR2 in the same manner as the infrared radiation emitted by the diode D of the gun CR1. The infrared radiation emitted by the diode D then starts the display process when it is received by a pick-up of one of the panels, namely, for example, the pick-up CA2 of the panel 1. Information signals are then emitted in series on the input line of the modem circuits 70 towards the computer system 100, this signals including the address code identifying the pick-up CA2 and the coded logic signals indicating that the camera C2 is a medium-field camera. According to the information thus received, the computer device 100 emits series of ASCII-coded signals towards the monitoring and control circuits 20 associated with the panels where the desired display is to take place. In fact, the computer device 100, according to the information received and to the program in PROM 103, is capable of emitting the ASCII-coded signals indicating the starting position of the message display on the display panels and the message portion concerned for each display panel. The addressing, decoding and display process from the monitoring and control devices 20 take place in accordance with the same process as the one described in connection with the use of the wide-field camera.

FIG. 1 precisely shows the position of the message ABCDEFGH as displayed on the various display panel elements after the excitation of the pick-up CA2. Thus, the characters CDEF of the message are displayed on the elements 1*a*–1*d*, respectively, of the panel 1, whereas the characters EDH are displayed on the display elements 2*a*–2*d*, respectively, the characters A and B being displayed on the two consecutive display elements preceding the display element 1*a*. It should be noted that the characters A and B of the beginning of the message displayed are also displayed on the dispaly elements 2*c* and 2*d*, respectively, of the panel 2 in order to anticipate the displacements or movements of the camera C2 during a normal and continuous pan-shot with successive excitation of the pick-ups, this pan-shot moving, in the case considered, from the left to the right with respect to FIG. 1.

When the pan-shot movement of the camera continues with excitation of the pick-up CA3 of the panel 2, the computer device again determines the position or location of the message on the panels by shifting towards the right the displayed message (in FIG. 1) of the two display elements, still displaying the two first characters A B of the message after the last character H (the two characters A and B being displayed at the display elements 3*b* and 3*c* of the panel 3).

In practice, the displacement of the message takes place in a time greater than a second for reasons of stabilization of the display of the message due to the inertia of the display pellets. The computer device 100 therefore informs the monitoring and control devices 20, every second, of the message to be displayed, the display starting position for each panel as well as the message portion concerned for each panel after the excitation of a pick-up, and ensures the control of the displacement of the message after the excitation of the following pick-up. The displacement speed is also controlled by the computer device 100, this speed being in fact defined as the displacement of the message by unit of time.

It is to be noted that the above-described display process takes place when the pick-up CA2 and the other successive pick-ups have been excited during a time greater than a predetermined time, for example of one second.

On the basis of the operating principle set forth hereabove, it is possible, from the program stored in the memory PROM103 of the computer system 100, to provide for the display of the message on the various display panel elements.

The example given hereabove illustrates the case of a pan-shot from left to right with respect to FIG. 1 and where the pick-ups CA1 and CA2 are excited successively.

If the pick-up CA1 is excited during a time shorter than the abovementioned time of one second, i.e. when the infrared radiation emitted by the camera C2 is received by the pick-up CA1 during a time shorter than one second, the program of the computer device 100 is so designed that no display order is sent through the line L1, L2 or that no change in message takes place if there already were a display of the message ABCDEFHG before the excitation of the pick-up CA1. This also applies to the case where the operation of the camera C2 is followed by the operation of another camera in medium-field mode with excitation of a pick-up during a time shorter than one second. Thereafter, if the pick-up CA2 is excited for more than one second during the pan-shot movement of the camera C2, the computer devices 100 emits for display at 6 display elements behind or at the left of the pick-up CA2 with respect to FIG. 1, which besides corresponds to the display configuration represented in this Figure and described previously. On the other hand, if the pick-up CA2 is excited during a time smaller than one second after the pick-up CA1 has also been excited during a time smaller than one second, which corresponds to a very quick displacement of the camera C2, then there will take place a display of the message ABCDEFGH from the display element 2*a* of the panel 2, i.e., the character A at the beginning of the message to be displayed will be displayed on this display element.

Of course, other anticipatory processes for message displays on panels may be devices without departing from the scope of the present invention, depending on the length of the message to be displayed, the distance between the camera operating in medium-plane mode and the display panels.

Furthermore, the program in PROM 103 is also designed not only to center as well as possible the message in the field of the camera in the manner explained above, but also to allow the correction of abnormalities adversely affecting the basic principle. Such abnormalities may take place in case of loss of the infrared radiation received by one of the pick-ups, or when two pick-ups are acted upon by a same infrared radiation. The computer device program may also take into account possible occurrences during a televised broadcase, such as for example a change of the type of camera or a change of shooting from one display zone to another display zone.

Such abnormalities and occurrences will be detailed successively hereunder.

A loss in infrared radiation takes place when one of the pick-ups acted upon by an infrared radiation is momentarily masked after the excitation of two consecutive pick-ups, e.g. CA1, CA2 (slow pan-shot movement of the camera) or CA1, CA4 (quick camera movement), or when the camera has so been momentarily displaced that the infrared beam no longer reaches the pick-ups. In the first case, the computer device interpolates the displacement speed of the camera and, at the lower speeds, will cause the display to take place on display element farther than the last display element taken into account, whereas at high speed, the display will take place two display elements farther than the last one taken into account. If two pick-ups are excited, for example the adjacent pick-ups CA1 and CA2, a distinction must be made between two cases. The first case is when there takes place an excitation of the two pick-ups during a time smaller than one second; there is then no change in the state of the display. In the contrary case, i.e. when the time of excitation exceeds one second, the computer device 100 causes the display in the same manner as in the case of signal loss, i.e. if the camera is displaced slowly, the computer device causes the display to take place one display element farther than the last display element taken into account, whereas at a high speed of the camera, the display takes place two display elements farther than the last one taken into account.

The possibility of a change of camera may be as follows: after two seconds, the shooting passes from the camera C2 to the camera C1 (therefore from the medium-shooting field to the wide-shooting field) and still takes place from the camera C2. The computer device 100 then causes a long-sized display with a beginning of the display four display elements before the pick-up excited or acted upon. If, before the end of the two seconds, the shooting passes from the camera C2 to the camera C1 and the shooting returns to camera C2, then no change of state of the display takes place. This process also applies in the reverse case of change of the shootings. Thus, these camera changes controlled by the computer device show that each infrared radiation pick-up is taken into account only at the end of two seconds.

The possibility of display zone changes may be reduced to two cases. The first case is the one where there takes place an abrupt change from two zones including the display panels 1,2 to a zone including the panels n−1 and n with a break of continuity of the excitation of the infrared radiation pick-ups between the two zones. The computer device, at the end of a duration of one second for validating the new position of the camera, causes the blanking of the message displayed at the panels 1,2 of the first zone and causes the display on the panels n−1, n two display elements before the pick-up acted upon (case of the short-sized display) or four display elements before this pick-up (case of long-sized display) if the change of zone is accomplished by a change from the camera operating in medium-field mode to a camera operating in wide-field mode). The second case is the passing from the shooting of the first zone to the shooting of the second zone without break of continuity and therefore of excitation of the infrared radiation pick-ups, but with a time of excitation of these pick-ups shorter than one second. In this case, the computer device 100 orders the beginning of the display from the pick-up located four pick-ups farther than the third pick-up excited during a time shorter than one second and which has allowed the interpolation of the displacement speed of the camera. The computer device therefore allows anticipating the quick displacement of the camera from the data received by the pick-ups excited during a time shorter than one second.

It is of course understood that all the cases set forth above are readily programmable by one skilled in the art and that other cases or possibilities may be devised without departing from the scope of the invention, provided the display of an advertising message practically follows the movements of the camera and this message appears entirely on a final television receiving means.

We claim:

1. A method of displaying information, such as for example advertising messages on a certain number of panels with display elements arranged such that a message may be made to run bidirectionally across said display elements at a place intended to be televised to at least one television receiving means from television cameras, at least one of the display panels appearing at said television receiving means when said display panels are in a shooting field of one of the cameras in operation, comprising the steps of emitting a signal from a camera position and detecting said signal at one of said panels, said signal being related to the shooting field of said camera, starting the display of an advertising message each time at least one of the panels is located in the shooting field of an operating one of the cameras responsive to said detection, and controlling the displacement of the message on the panels according to the movements of the camera in such a manner as to cause said message to continuously appear at approximately the same position within said television receiving means, whereby said message continually appears at said television receiving means.

2. A method according to claim 1, further comprising the steps of determining the size of said advertising message according to the operating focal distance of said camera in such a manner that the message is always entirely located in the shooting field of the camera.

3. A method according to claim 1, further comprising the steps of starting said display by detecting infrared radiation emitted from an infrared radiation gun located on the camera when the latter is switched on and receiving said infrared radiation by an infrared radiation pick-up arranged on one of the display panels.

4. A method according to claim 1, further comprising the steps of determining the position of the beginning of the display of said message on the display panels and of determining also the message portion to be displayed at each display panel according to the operating focal distance of said camera.

5. A method according to claim 4, wherein said message displacement, said display starting position, said message portion to be displayed at each panel, a type of message to be displayed and a message displacement speed are controlled by a computer device.

6. A method according to claim 3, further comprising the steps of pulsing said infrared radiation and of inserting into the active portion of the pulsed infrared signal coded information signals indicating the operating focal distance of the camera used and the relative position of the camera with respect to the display panels.

7. A method according to claim 5, further comprising the steps of emitting towards the computer device a signal of identification of the infrared radiation pick-up having received an infrared radiation from said gun.

8. A method according to claim 7, further comprising the steps of providing, according to a predetermined program of the computer device, for the location of the message on the various display panel elements according to the time of excitation of each infrared radiation pick-up when the camera in movement is operating at a focal distance corresponding to a medium-shooting field.

9. A method according to claim 3, further comprising the step of, when no infrared radiation is received by an infrared radiation pick-up after the excitation of the preceding two infrared radiation pick-ups on the panels, and according to said program, determining the location of the message to be displayed on the various display panel elements taking into account camera displacement speed.

10. A method according to claim 1, further comprising the step of, in case of a change of shooting field from a camera operating in medium-shooting-field mode to a camera operating in wide-shooting-field mode while remaining at the last shooting field considered after the end of a predetermined period, determining in an appropriate manner the location of the message on the various display panel elements.

11. A method according to claim 1, further comprising the step of, in case of an abrupt change by a camera of shooting display panel elements to other different panel elements and after excitation during a predetermined time of an infrared radiation pick-up of the other panel elements in the shooting field of said camera, determining the location of the message on the shot panel elements according to the speed of displacement of the camera from the display panel elements initially shot to the other panel elements.

12. A method according to claim 3, further comprising the step of, in case of a change from one camera shooting panel elements to another shooting panel elements with consecutive excitation of at least three infrared radiation pick-ups on the display panels of a duration shorter than a predetermined time, starting the display of the message on an appropriate number of display panel elements from the pick-up located four pick-ups farther than a third pick-up of the three pick-ups used for the interpolation of the speed of displacement of the camera from the panel elements toward the other panel elements.

13. A display system including a certain number of panels with display elements arranged at a place, a certain number of television cameras for televising to at least one television receiving means, at least one of the display panels appearing at said television receiving means when said display panels are in the shooting field of one of the cameras in operation, comprising:

in association with each of the cameras, means for generating a signal comprising an element arranged on each of the cameras and sensitive to an "on-the-air" visual indicator of the camera and a starting device activated by said sensitive element;

means situated at at least one display panel for receiving said signal and for beginning the display of an advertising message every time at least one of the display panels is located in the shooting field of the camera in operation;

a computer device receiving information from the outputs of the receiving means and emitting logic signals towards each of the display monitoring and control devices associated with eacn panel for causing the displacement of the message on the display panel elements according to the movements of the camera in such a manner as to cause said message to continually appear at said television receiving means.

14. A system according to claim 13, wherein said starting device includes an infrared radiation gun aligned with the shooting axis of said camera and a certain number of infrared radiation pick-ups arranged at regular intervals on the display panel and connected to the computer device, each output signal of a pick-up receiving the infrared radiation containing information identifying said pick-up and other information relating to the operating focal distance of the camera, so that the computer device addresses the various display panel elements to display the message on the panel over a length corresponding to the focal distance of the camera used.

15. A system according to claim 13, wherein said logic signals, coded in ASCII, emitted by said computer device control the displacement and, in addition, indicate a type of message to be displayed, the display starting position for each display panel, the message portion concerned for each panel and a message displacement speed on the display panel elements.

16. A system according to claim 13, further comprising an electronic device for pulsing the infrared radiation emitted by the emitting diode of the infrared radiation gun of the camera in operation and means for inserting into the active portion of the pulsed signal information relating to the operating focal distance of the camera in operation and to the position of the camera with respect to the display panels.

17. A system according to claim 13, wherein said sensitive element includes a photocell placed against the "on-the-air" indicator light of each camera.

18. A system according to claim 13 wherein each monitoring and control device includes a microprocessor connected to a random access memory in which are stored the portions of the messages to be displayed.

19. A method of displaying advertising messages on a certain number of panels with display elements arranged such that a message may be made to run bidirectionally across said display elements at a place intended to be televised to at least one television receiving means from television cameras, at least one of the display panels appearing at said television receiving means when said display panels are in a shooting field of one of the cameras in operation, comprising the steps of emitting a signal from a camera position and detecting said signal on one of said panels, said signal being related to said shooting field of said camera, starting the display of an advertising message each time at least one of the panels is located in the shooting field of an operating one of the cameras responsive to said detection, controlling the displacement of the message on the panels according to the movements of the camera in such a manner as to cause said message to continually appear at appoximately the same position within said shooting field, and determining the operating focal distance of said camera and controlling the size of said advertising message in response to said focal distance determination in such a manner that the message is always entirely located in the shooting field of the camera, whereby said message continually appears at said television receiving means.

20. A method of displaying advertising messages on a certain number of panels with display elements arranged such that a message may be made to run bidirectionally across said display elements at a place intended to be televised to at least one final television receiving means from television cameras, at least one of the display panels appearing at said television receiving means when said display panels are in a shooting field of one of the cameras in operation, comprising the steps of emitting a signal from a camera position and detecting said signal at one of said panels, said signal being related to said shooting field of said camera, starting the display of an advertising message every time at least one of the panels is located in the shooting field of an operating one of the cameras responsive to said detection, controlling the displacement of the message on the panels according to the movements of the camera in such a manner as to cause said message to continually appear at approximately the same position within said shooting field, starting said display by detecting infrared radiation emitted from a infrared radiation gun located on the camera when the latter is switched on, receiving said infrared radiation by an infrared radiation pick-up arranged on one of the display panels, pulsing said infrared radiation and inserting into the active portion of the pulsed infrared signal coded information signals indicating the operating focal distance of the camera used and the relative position of the camera with respect to the display panels, whereby said message continually appears at said television receiving means.

21. A display system including a certain number of panels with display elements arranged at a place, a certain number of television cameras for televising to at least one television receiving means, at least one of the display panels appearing at said television receiving means when said display panels are in the shooting field of one of the cameras in operation, comprising;

in association with each of the cameras, means for generating a signal comprising an element arranged on each of the cameras and sensitive to an "on-the-air" visual indicator of the camera and a starting device activated by said sensitive element;

means situated at at least one display panel for receiving said signal and for beginning the display of an advertising message every time at least one of the display panels is located in the shooting field of the camera in operation;

a computer device receiving information from the outputs of the receiving means and emitting logic signals towards each of the display monitoring and control devices associated with each panel causing the displacement of the message on the display panel elements according to the movements of the camera in such a manner as to cause said message to continually appear at said television receiving means;

said starting device including an infrared radiation gun aligned with the shooting axis of said camera and a certain number of infrared radiation pick-ups arranged at regular intervals on the display panel and connected to the computer device, each output signal of a pick-up receiving the infrared radiation containing information identifying said pick-up and other information relating to the operating focal distance of the camera, so that the computer device addresses the various display panel elements to the display the message on the panel over a length corresponding to the focal distance of the camera used; and an electronic device for pulsing the infrared radiation emitted by an emitting diode of the infrared radiation gun of the camera in operation and means for inserting into the active portion of the pulsed signal information relating to the operating focal distance of the camera in operation and to the position of the camera with respect to the display panels.

* * * * *